US007571829B2

(12) United States Patent
Gersovitz

(10) Patent No.: US 7,571,829 B2
(45) Date of Patent: Aug. 11, 2009

(54) MULTI-COMPARTMENT CONTAINER

(76) Inventor: Gerry Gersovitz, 135 Main St., Suite 1130, San Francisco, CA (US) 94105

( * ) Notice: Subject to any disclaimer, the term of this patent is extended or adjusted under 35 U.S.C. 154(b) by 445 days.

(21) Appl. No.: 10/948,837

(22) Filed: Sep. 22, 2004

(65) Prior Publication Data

US 2005/0115964 A1 Jun. 2, 2005

Related U.S. Application Data

(60) Provisional application No. 60/505,410, filed on Sep. 23, 2003.

(51) Int. Cl.
*B65D 21/032* (2006.01)

(52) U.S. Cl. ..... 220/4.27; 220/4.06

(58) Field of Classification Search ..... None
See application file for complete search history.

(56) References Cited

U.S. PATENT DOCUMENTS

| | | | | |
|---|---|---|---|---|
| 861,815 | A | | 7/1907 | Cullen |
| 1,634,569 | A | | 7/1927 | Bray |
| 1,798,071 | A | | 3/1931 | Deane |
| 1,837,343 | A | | 12/1931 | Starke et al. |
| 2,073,636 | A | | 3/1937 | Holoubek |
| 2,371,173 | A | | 3/1945 | Hothersall |
| 2,553,559 | A | | 5/1951 | Eckman |
| 2,605,013 | A | | 7/1952 | Rubenstein |
| 2,611,499 | A | | 9/1952 | Mayer |
| 2,833,436 | A | * | 5/1958 | Ruderian ..... 215/6 |
| 3,144,152 | A | | 8/1964 | Kopp |
| 3,465,905 | A | * | 9/1969 | Schottanes ..... 215/6 |
| 4,078,686 | A | | 3/1978 | Karesh |
| 4,444,324 | A | | 4/1984 | Grenell |
| 4,598,832 | A | * | 7/1986 | Alonso ..... 215/6 |
| 4,925,055 | A | * | 5/1990 | Robbins et al. ..... 220/495.06 |
| 5,258,191 | A | * | 11/1993 | Hayes ..... 426/107 |
| 5,279,841 | A | | 1/1994 | Yu |
| 5,499,738 | A | | 3/1996 | Burleigh |
| 5,630,523 | A | | 5/1997 | Wright |
| 5,731,020 | A | | 3/1998 | Russo |
| 5,803,294 | A | | 9/1998 | Bello |
| 6,105,812 | A | | 8/2000 | Riordan |
| 6,196,412 | B1 | | 3/2001 | Cattell |
| 6,415,940 | B1 | | 7/2002 | Brabson |
| 6,450,351 | B1 | | 9/2002 | Thompson |
| 2001/0040164 | A1 | | 11/2001 | Cleator |

FOREIGN PATENT DOCUMENTS

| | | |
|---|---|---|
| FR | 2701924 A1 | 9/1994 |

* cited by examiner

*Primary Examiner*—Stephen J. Castellano
(74) *Attorney, Agent, or Firm*—Townsend and Townsend and Crew LLP

(57) ABSTRACT

A multi-unit storage device wherein two separate containers are held together at their bottom portions. The separate containers are vacuum sealed at their top portions such that when the top portions are opened, the vacuum seal is broken and access to the products contained therein is provided.

6 Claims, 1 Drawing Sheet

Figure 1
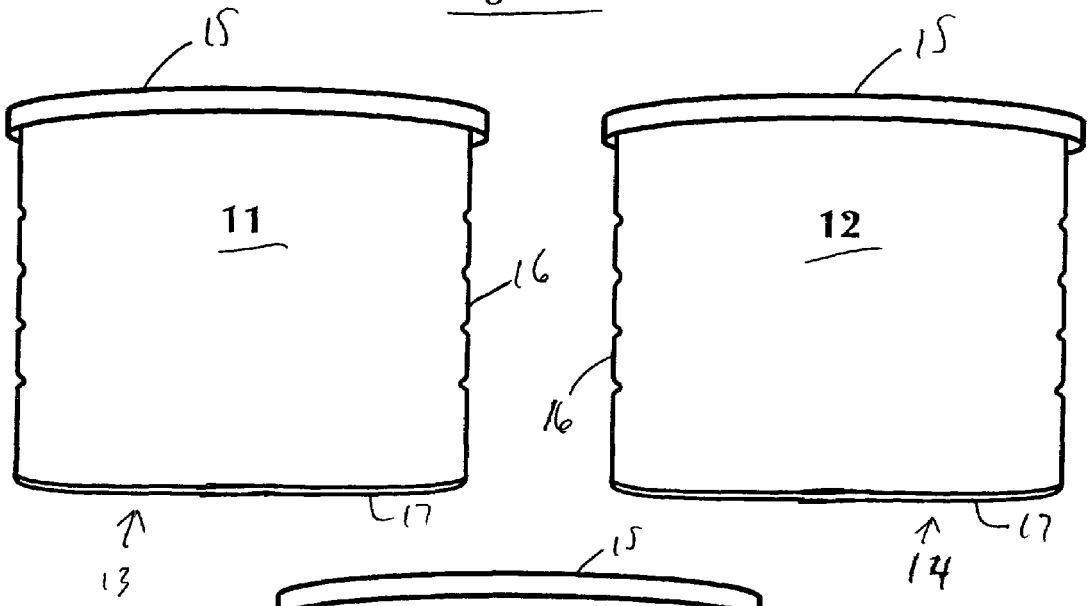
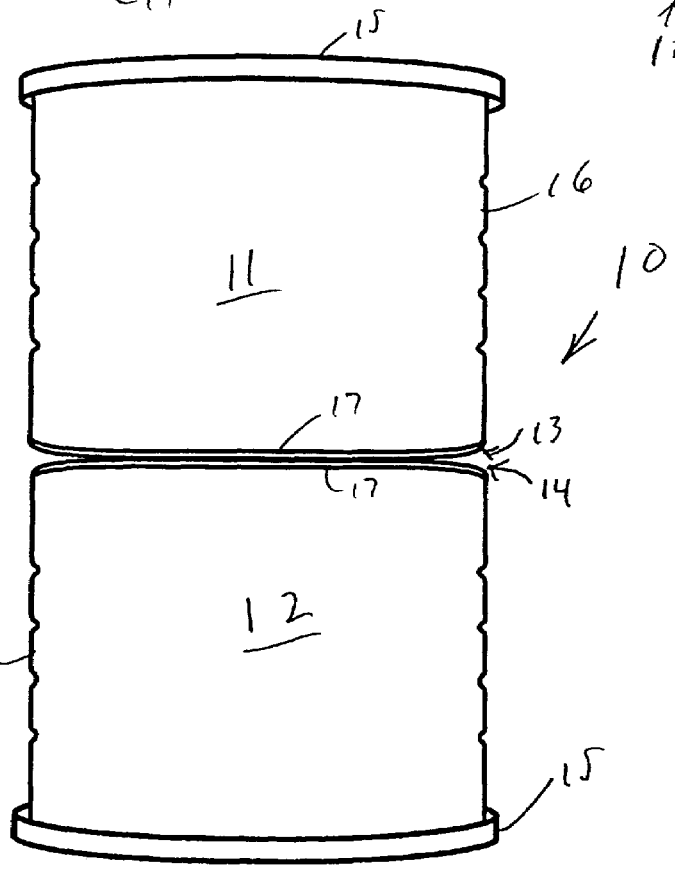
Figure 2

MULTI-COMPARTMENT CONTAINER

CROSS-REFERENCES TO RELATED APPLICATIONS

This application is a non-provisional application and claims the benefit of Application No. 60/505,410, filed Sep. 23, 2003, entitled "Multi-Compartment Container," the disclosure of which is incorporated herein by reference for all purposes.

STATEMENT AS TO RIGHTS TO INVENTIONS MADE UNDER FEDERALLY SPONSORED RESEARCH AND DEVELOPMENT

Not applicable

REFERENCE TO A "SEQUENCE LISTING," A TABLE, OR A COMPUTER PROGRAM LISTING APPENDIX SUBMITTED ON A COMPACT DISK

Not applicable

BACKGROUND OF THE INVENTION

1. Field of the Invention

The present invention relates to multiple compartment storage devices, and more particularly, to a multiple-unit storage device that essentially consists of two separate containers coupled together at their bottom portions in a stacked arrangement.

2. Description of the Prior Art

In the packaging of certain products where freshness is a concern, it is desirable to have multiple compartments in which one part of the container may be opened, while another part of the container may be left sealed. By way of example, one such product is coffee. Coffee is generally packaged in a container under vacuum. When coffee is exposed to atmospheric conditions, it may lose its aroma and flavor. Thus, when a can of coffee is opened, the entire contents of the can is exposed to such atmospheric conditions due to the loss of the vacuum conditions.

BRIEF SUMMARY OF THE INVENTION

Broadly, the present invention provides a multi-unit storage device where two separate containers are held together at their bottom portions. Preferably, the separate containers are vacuum sealed at their top portions such that when the top portions are opened, the vacuum seal is broken and access to the products contained therein is provided.

In accordance with one aspect of the present invention, a multi-unit storage device comprises a first container comprising a top portion and a bottom portion, a second container comprising a top portion and a bottom portion, the first and second portions being substantially permanently coupled together at their bottom portions in a stacked arrangement, and at least one removable lid for coupling to a top portions. Each of the two separate containers is individually vacuum sealed at their respective top portions.

In accordance with another aspect of the present invention, each container is a one-piece container.

In accordance with a further aspect of the present invention, each container includes ribs defined within a sidewall.

In accordance with another aspect of the present invention, each container comprises a cylindrical sidewall and a bottom.

In accordance with yet another aspect of the present invention, the first and second containers are coupled together via welding.

In accordance with a further aspect of the present invention, the first and second containers are coupled together via an adhesive.

The present invention also provides a method of packaging at least one type of product, where the method comprises providing first and second separate containers comprising top and bottom portions, coupling, in a substantially permanent manner, the first and second separate containers together at their bottom portions in a stacked arrangement to form a multi-unit storage container, placing product into the first container, placing product into the second container, and vacuum sealing the two separate containers at their top portions.

In accordance with one aspect of the present invention, the product is placed into each container prior to the two separate containers being coupled together.

In accordance with another aspect of the present invention, the product is placed into each container after the two separate containers have been coupled together.

In accordance with a further aspect of the present invention, the method comprises placing a removable lid over at least one top portion after that container has been vacuum sealed.

Other features and advantages of the present invention will be apparent upon review of the following detailed descriptions of preferred exemplary embodiments.

BRIEF DESCRIPTION OF THE DRAWINGS

FIG. 1 is an elevation view of two containers for a multi-unit storage device in accordance with the present invention; and FIG. 2 is an elevation view of the two containers forming a multi-unit storage device in accordance with the present invention

DETAILED DESCRIPTION OF THE INVENTION

With reference to FIGS. 1 and 2, a multi-unit storage device 10 in accordance with the present invention is illustrated. Preferably, the multi-unit storage device consists of two containers or cans 11, 12, preferably made of metal, that are welded together at their bottom portions 13, 14. Glue or some other type of adhesive may also be used.

The top portions are preferably vacuum sealed with either metal, foil, plastic or any other suitable material. Examples for the two separate containers include coffee cans, nut cans, potato chip cans, and other types of snacks. Preferably, lids 15 are provided for closing or resealing the cans 11, 12.

The separate cans may be made in any manner known in the prior art. Early methods of making such cans included rolling a metallic body or sidewall 16 and coupling a metallic bottom 17 to the body portion with a folded or sealed flange. Additionally, the bottom may be coupled to the rolled body with a welding-type process. Modern methods include stamping or forming the bottom and body as a single piece. When the bottom and body are made of a single piece, ribs or troughs 18 may be defined circumferentially in the body or sidewall as is known in the art to provide extra strength and stability.

Another example of a type of container that may be used as the containers to form the multi-unit storage device in accordance with the present invention includes a cardboard or plastic body 16 with a metal, or plastic bottom 17. The containers may also be made of one-piece consisting of plastic or other suitable material. Examples of such a container include orange juice cans, nut cans, some potato snack cans and other snack cans.

In use, two containers 11, 12 as described above are provided and are coupled together at their bottom portions 13, 14. Each can or container is filled with a product and then individually vacuum sealed. This may be done before or after the two containers are coupled to one another. Each container may be filled with the same product or a different product. Examples of products include, but are not limited to, coffee, nuts, potato chips, candy, tea, etc.

When one desires access to a product, one simply opens one container. Thus, the second container remains unopened, thereby protecting the product therein from the elements and helping maintain freshness. When access to the second container is desired, then the multi-unit storage device is "flipped" and the second container is opened. Each container may be closed with lids 15 if provided. One lid may be provided and used for both containers if desired.

Additionally, each separate container may be filled with a different product if it is so desired. For example, one container may include potato chips while the second container may include corn chips.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A multi-unit storage device, comprising:

a first metal container comprising a top end providing access when the top end is opened;

a cylindrical wall coupled to the top end, wherein the cylindrical wall has a same diameter at the top end and at the bottom end; and a substantially flat bottom end, wherein the bottom end and the cylindrical wall are of a one-piece construction;

a second metal container separate comprising a top end providing access when the top end is opened;

a cylindrical wall coupled to the top end, wherein the cylindrical wall has a same diameter at the top end and at the bottom end; and a substantially flat bottom end, wherein the bottom end and the cylindrical wall are of a one-piece construction; and a removable snap-type lid having a lip that snaps over the top end of one of the first and second containers, wherein the first and second containers are separate containers substantially permanently coupled together with an adhesive connecting material or welding at the bottom ends in a stacking arrangement, wherein at least a portion of each of the bottom ends are in contact with each other, and wherein each of the first and the second containers is individually vacuum sealed.

2. The multi-unit storage device of claim 1, wherein each of the first and second containers is individually vacuum sealed at the top end.

3. The multi-unit storage device of claim 1, wherein at least one of the cylindrical walls includes a plurality of ribs.

4. The multi-unit storage device of claim 1, wherein at least one of the first and second containers is individually vacuum sealed with dry goods therein.

5. The multi-unit storage device of claim 1, wherein at least one of the first and second containers is individually vacuum sealed with coffee therein.

6. The multi-unit storage device of claim 1, further comprising a second removable lid.

* * * * *

UNITED STATES PATENT AND TRADEMARK OFFICE

CERTIFICATE OF CORRECTION

PATENT NO. : 7,571,829 B2
APPLICATION NO. : 10/948837
DATED : August 11, 2009
INVENTOR(S) : Gerry Gersovitz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 757 days.

Signed and Sealed this

Seventh Day of September, 2010

David J. Kappos

David J. Kappos
*Director of the United States Patent and Trademark Office*